US007926415B2

(12) United States Patent
Yoakim et al.

(10) Patent No.: US 7,926,415 B2
(45) Date of Patent: Apr. 19, 2011

(54) CAPSULE WITH BIASING SEALING MEMBER

(75) Inventors: Alfred Yoakim, St-Legier-la Chiesaz (CH); Gilles Gavillet, Ursy FR (CH); Jean-Paul Denisart, La Conversion (CH)

(73) Assignee: Nestec S.A., Vevey (CH)

( * ) Notice: Subject to any disclaimer, the term of this patent is extended or adjusted under 35 U.S.C. 154(b) by 933 days.

(21) Appl. No.: 11/737,334

(22) Filed: Apr. 19, 2007

(65) Prior Publication Data

US 2007/0202237 A1 Aug. 30, 2007

Related U.S. Application Data

(63) Continuation of application No. PCT/EP2005/011307, filed on Oct. 20, 2005.

(30) Foreign Application Priority Data

Oct. 25, 2004 (EP) ..... 04025321

(51) Int. Cl.
*A47J 31/00* (2006.01)
*B65D 85/00* (2006.01)
*B65B 29/02* (2006.01)

(52) U.S. Cl. ..... 99/295; 99/323; 426/77

(58) Field of Classification Search ..... 99/295, 99/323, 289 R; 426/77, 82, 112, 115
See application file for complete search history.

(56) References Cited

U.S. PATENT DOCUMENTS

| | | | | |
|---|---|---|---|---|
| 4,136,202 | A * | 1/1979 | Favre | 426/77 |
| 4,471,689 | A * | 9/1984 | Piana | 99/295 |
| 5,008,013 | A * | 4/1991 | Favre et al. | 210/482 |
| 5,072,661 | A * | 12/1991 | Kondo | 99/296 |
| 5,402,707 | A | 4/1995 | Fond et al. | 99/295 |
| 6,832,542 | B2 * | 12/2004 | Hu et al. | 99/302 R |
| 6,955,116 | B2 * | 10/2005 | Hale | 99/295 |
| 7,640,842 | B2 * | 1/2010 | Bardazzi | 99/295 |
| 2001/0052294 | A1 | 12/2001 | Schmed | 99/295 |
| 2003/0089245 | A1 | 5/2003 | Kollep et al. | 99/495 |

FOREIGN PATENT DOCUMENTS

| | | |
|---|---|---|
| DE | 14 29 932 A1 | 3/1969 |
| FR | 2 041 380 | 1/1971 |

OTHER PUBLICATIONS

WO 93/17932 (Cordone et al.) Sep. 16, 1993.*

Final Office Action mailed Feb. 3, 2011 for U.S. Appl. No. 11/737,560 filed Apr. 19, 2007.

Notice of Allowance mailed Jan. 10, 2011 for U.S. Appl. No. 11/258,433 filed Oct. 25, 2005.

* cited by examiner

*Primary Examiner* — Reginald L Alexander
(74) *Attorney, Agent, or Firm* — Winston & Strawn LLP

(57) ABSTRACT

A capsule for containing beverage ingredients is designed to be inserted in a beverage production device in order to have water under pressure enter the capsule in order to interact with the ingredients in the capsule. The capsule includes a base body and a foil member closing the base body by being attached to a flange-like rim extending from the side wall of the base body of the capsule. The capsule thereby includes a resiliently deflectable sealing member which is designed to be biased against a sealing surface of a holder of the beverage production device when the capsule is positioned in the beverage production device. The sealing engagement of the sealing member of the capsule and the sealing surface is self-reinforcing when pressurized.

13 Claims, 5 Drawing Sheets

CAPSULE WITH BIASING SEALING MEMBER

CROSS-REFERENCE TO RELATED APPLICATIONS

This application is a continuation of International application PCT/EP2005/011307 filed Oct. 20, 2005, the entire content of which is expressly incorporated herein by reference thereto.

BACKGROUND

The present invention generally relates to capsules for containing beverage-forming ingredients, a beverage producing system for use in connection with such capsules as well as to methods for producing beverages using such capsules.

The background of the present invention is the field of capsules which are adapted to contain beverage or other comestible (e.g., soup) ingredients. By means of an interaction of these ingredients with a liquid, a beverage or other comestibles, such as for example soups, can be produced. The interaction can be for example an extraction, brewing, dissolution, etc. process. Such a capsule is particularly suited to contain ground coffee in order to produce a coffee beverage by having hot water under pressure enter the capsule and draining a coffee beverage from the capsule.

The systems and methods for obtaining fluid comestibles from substances containing capsules are for example known from U.S. Pat. No. 5,402,707. The capsule 101 as shown therein in FIG. 1 has a frustoconically-shaped cup 102 which may be filled e.g. with roasted and ground coffee 103 and which is closed by a foil-like tear face cover 104 welded and/or crimped to a flange-like rim which extends laterally from the side-wall of cup 102. A capsule holder 111 comprises a flow grill 112 with relief surface element members 113 and an annular chamfered rim 114. The capsule holder 111 is accommodated in its support 115 which has a lateral wall 124, and a bore 127 for the passage of extracted coffee beverage.

As can be seen from FIG. 1, the extraction system further comprises a water injector 107 having a water inlet channel 120 and an annular element 108 with an internal recess of which the shape substantially corresponds to the outer shape of the capsule. On its outer part, the bell member 108 comprises a spring 122 holding a ring 123 for releasing the capsule on completion of extraction.

In operation, a capsule 101 is placed in the capsule holder 111. The water injector 107 perforates the upper face of the cup 102. The lower tear face 104 of the capsule rests on the radially arranged members 113 of the capsule holder 111. The water is injected through the channel 120 of the water injector 107 and impinges on the bed 103 of coffee. The pressure in the capsule 101 increases and the tear face 104 increasingly follows the shape of the radial opening relief members 113. When the constituent material of the tear face reaches its breaking stress, the tear face tears along the relief members. The extracted coffee flows through the orifices of the flow grill 112 and is recovered in a container (not shown) beneath the bore 127.

The principles of this extraction process as far as it can be maintained in connection with the present invention can be summarized as follows:

a sealed capsule is inserted in capsule holder means;

the capsule holder means is then associated with water injection means of the machine such that an annular element (108 in FIG. 4) surrounds the capsule;

in a first wall of the capsule at least one opening is generated, and water entering the capsule through the opening in the first wall is interacting with the ingredients in the interior of the capsule and the thus produced beverage is then drained from at least a second opening is created in the second wall.

The ingredients in the capsule constitute the "bottleneck" of the flow path of the water and will therefore cause a pressure drop between the upstream and the downstream side of the liquid flow through the capsule, which pressure drop will even increase during the interaction between the liquid and the ingredients for example due to a swelling of the ingredients. Correspondingly it has to be assured that the only water flow is actually taking place through the interior of the capsule (arrow A1) and that no water can flow from the water injector into the interstice between the annular enclosing member 108 and the exterior of the capsule 101 and then to the draining bore 127 of the device. The arrow A2 illustrates this undesired external water flow path. With other words, any water flow exterior to the capsule 101 has to be stopped (or at least hindered to a substantial degree) by a sealing engagement being positioned in the interstice between the annular member 108 and the capsule 101 and in the flow path between the water injector and the beverage-draining bore. In the prior art embodiment shown in FIG. 1 such sealing engagement can be achieved by the pinching engagement between the annular member 108, the flange-like rim of the side wall of the capsule 101 and the capsule holder.

In case the sealing engagement is not working properly and water is flowing outside the capsule, no pressure sufficient to cause the tearing of the tear face will be built up inside the capsule, or alternatively, a too low pressure will be causing partial tearing of the tear face and therefore only a poor extraction of the substance, consequently, leading to the delivery of a low quality beverage. In such a scenario water will be drained from the beverage production device without having interacted or fully interacted under sufficient pressure conditions with the ingredients contained in the capsule.

In the prior art improvements are known in which this sealing engagement is further improved by lining the inner wall of the annular member with a rubber-elastic material. With other words, according to said prior art the sealing engagement is assured by structures fixed to or attached with the beverage-producing device. This has disadvantages in that after the use of a substantial number of capsules a wearing off of the fixed sealing means can take place such that the quality of the produced beverage is increasingly deteriorated by water passing the no longer properly efficient sealing.

Any "leak" at the exterior of the capsule reduces the pressure build-up inside the capsule. On the other hand, it is well known that a sufficient extraction pressure is a key factor for the quality of espresso-style coffee.

Accordingly, there is a need for improvements in the sealing means of such capsules, and these are now provided by the present invention.

SUMMARY OF THE INVENTION

The present invention correspondingly aims at an improvement of the sealing engagement positioned between the liquid inlet and the beverage draining side of such a beverage production system.

It is thereby the central feature of the present invention to transfer the giving cooperation member of the sealing engagement from the beverage production device to the capsule. The advantage is that the giving cooperation member then is only used once (i.e., only with the associated capsule)

such that a proper functioning of the sealing can be assured and no hygienic problems can occur at the sealing member.

Note that the present invention thus especially aims at an improvement of the capsules, such that state-of-the-art beverage production devices with integrated sealing means such as, for example that shown in U.S. Pat. No. 5,402,707, can also be used in connection with a capsule according to the present invention. For this reason, that patent is expressly incorporated herein by reference.

A first aspect of the invention relates to a capsule comprising a chamber defining an interior for containing beverage-forming ingredients, wherein the capsule is operatively associated with a beverage production device such that a liquid under pressure from the device can enter the capsule in order to interact with the beverage-forming ingredients therein and form a beverage, with the capsule having an exterior surface that presents a resiliently deflectable sealing member for sealingly engaging the beverage production device in order to assist in directing the liquid to traverse the capsule interior without leakage so that the liquid contacts the beverage-forming ingredients and forms the beverage.

Another aspect of the present invention relates to a beverage producing system comprising a capsule as disclosed herein and a beverage production device. The beverage production device has at least one sealing surface against which the sealing member of the capsule is biased when the capsule is positioned in the beverage production device and/or when water pressure is build up in the beverage production device for water to traverse only the interior of the capsule.

Other aspects of the invention relate methods for producing a beverage utilizing the capsules and systems disclosed herein.

Further advantages, features and objects of the present invention will become evident for the man skilled in the art when reading the following detailed description of embodiments of the present invention taking in conjunction with the figures of the enclosed drawings.

DETAILED DESCRIPTION OF THE PREFERRED EMBODIMENTS

Figure 1:
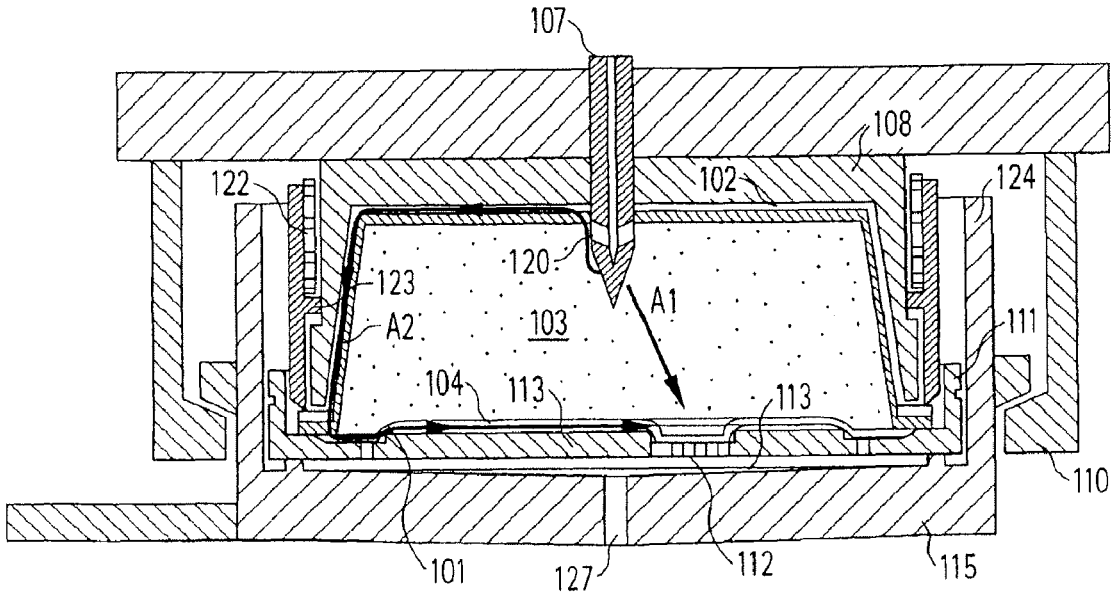
FIG. 1 shows an extraction capsule known from U.S. Pat. No. 5,402,707.

According to a first aspect of the present invention, a capsule for containing beverage ingredients is designed for being inserted in a beverage production device in order to have a liquid under pressure have enter the capsule in order to interact with the ingredients in the capsule. The exterior of the capsule thereby presents a resiliently deflectable sealing member.

The sealing member can be geometrically arranged to be biased against at least one sealing surface of the beverage production device when the capsule is positioned in the beverage production device and/or when water pressure is build up in the beverage production device in order to make water traverse the interior of the capsule. The biasing effect can occur upon closure or only under the effect of water pressure or both at closure and under water pressure.

In an example, the sealing member is configured to be biased against a sealing surface of an enclosing member of the beverage production device. Therefore, tightness is ensured between the capsule and the enclosing member to ensure that water is not drained along the external surface of the capsule and that the proper pressure level can build inside the capsule. In such a mode, there is no need for a sealing member as part of the beverage production device.

In a possible mode, the sealing member is configured to be biased against the sealing surface of the capsule holder. The sealing member can be biased both against the enclosing member and the capsule holder; in which case there is no a need for a sealing member as part of the beverage production device.

In an alternative embodiment, the sealing member can be biased only against the capsule holder; in which case there would be need for a sealing member, e.g., static or dynamic sealing means, of the beverage production device to ensure the pressure of fluid building properly in the capsule. The additional advantage of this mode would essentially be to facilitate removal of the capsule and avoid the capsule being maintained by vacuum in the capsule holder.

The resiliently deflectable sealing member can be part of a flange-like rim of the capsule. The flange-like rim can comprise a clamping portion that bears the clamping forces when the capsule is held in position in the beverage device. As a result, the sealing member can freely deflect under pressure and provide an effective seal. For instance, the sealing member can be a free lip extending from the rim of the capsule.

The deflectable sealing member can present the shape of a lip, such as e.g. a ring-shaped lip. The capsule generally comprises a cup-shaped base body, with the resiliently deflectable sealing member being provided at the side wall of the base body of the capsule. The sealing member is preferably made from a flexible material, while the capsule and the sealing member can be made from plastics.

The sealing member is designed to produce with the sealing surface of the beverage production device a self-reinforcing arrangement when pressure of water is applied during operation of the capsule to produce the beverage.

Another aspect of the present invention relates to a beverage producing system comprising a capsule and a beverage production device. The beverage production device has at least one sealing surface against which the sealing member of the capsule is biased when the capsule is positioned in the beverage production device and/or when water pressure is build up in the beverage production device for water to traverse only the interior of the capsule. The sealing member produces a self-reinforcing sealing arrangement when pressurized against the sealing surface.

The beverage production device advantageously includes an enclosing member having a sealing surface being in sealing engagement with the sealing member of the capsule when the capsule is positioned in the device and/or when pressurized, such that the sealing engagement as created between the sealing member and the sealing surface is self-reinforcing when pressurized. Preferably, the sealing member is configured, dimensioned and positioned to produce a self-reinforcing sealing arrangement when pressurized against the sealing surface.

A further aspect of the present invention relates to a method for producing a beverage which comprises:

providing a capsule containing ingredients, positioning the capsule in a beverage production device, producing at least a first opening in a first wall member of the capsule, allowing a liquid enter the capsule at said at least first opening in the capsule, producing at least a second opening in a second wall member and draining a beverage from the said at least second opening of the capsule, and separating the at least first and at least second openings by a sealing engagement of at least one sealing surface of the beverage production device and a sealing member at the exterior of the capsule, the sealing member being biased against the sealing surface of the beverage producing device.

Another method for producing a beverage:

providing a capsule containing beverage-forming ingredients, wherein the capsule is operatively associated with a beverage production device such that a liquid under pressure from the device can enter the capsule in order to interact with the beverage-forming ingredients therein and form a beverage, and with the capsule having an exterior surface that presents a resiliently deflectable sealing member for sealingly engaging a beverage production device in order to assist in directing a liquid to traverse the capsule interior without leakage so that the liquid contacts the beverage-forming ingredients and forms the beverage;

positioning the capsule in a beverage production device that includes at least one sealing surface that engages the resiliently deflectable sealing member in order to provide a sealing engagement between the at least one sealing surface of the beverage production device and the sealing member of the capsule, with the sealing member being biased against the sealing surface of the beverage producing device, producing at least a first opening in a first wall member of the capsule, allowing liquid enter the capsule at the at least first opening in the base body to contact the beverage-forming ingredients and form the beverage, and producing at least a second opening in a second wall member of the capsule for draining the beverage therefrom.

A still further aspect of the present invention relates to another method for producing a beverage which comprises:

providing a capsule containing ingredients, positioning the capsule in a beverage production device, producing at least one opening in a first wall member of the capsule, allowing a liquid enter the capsule at said at least first opening in the capsule, producing at least a second opening in a second wall member and draining a beverage from the said at least second opening of the capsule, separating the at least first and at least second openings by a sealing engagement of a sealing surface of the beverage production device and a sealing member at the exterior of the capsule, such that the sealing engagement is self-reinforced when pressurized under water pressure.

Turning now to the drawings with specific reference to FIG. 2, the first embodiment will be explained in detail. Note that in the following the invention will be explained referring to a certain design of a capsule, i.e., a design according to which the capsule comprises a cup-like base body and a closing foil member. However, it is to be understood than other designs of the capsule are viable, such as e.g. capsules having a lenticular form with two essentially matching foils being sealed at the e.g., ring-shaped edge. Generally a capsule according to the present invention comprises at least two wall members which are connected to each other at the edges to form a sealed flange-like rim area.

Comparable to the prior art also this embodiment shows a capsule holder 13 having relief elements 12 which are designed to tear and perforate a foil member 5 closing off a cup-like base body 4 of the capsule 1. This tearing of the foil member can e.g. occur as soon as the pressure inside the capsule exceeds a threshold value. Note that the relief elements can have any protruding shape able to cause a (partial) tearing of the foil member. As an example only pyramids, needles, bumps, cylinders, elongated ribs are cited.

Within the capsule 1 ingredients 3 are contained, wherein the ingredients 3 are selected such that a beverage can be produced when having a liquid entering the capsule in the region of the top wall 17 of the capsule 1 and then interact which such ingredients 3. Preferred ingredients are e.g. ground coffee, tea or any other ingredients from which a beverage or other liquid or viscous comestible (e.g. soup) can be produced.

Figure 2:
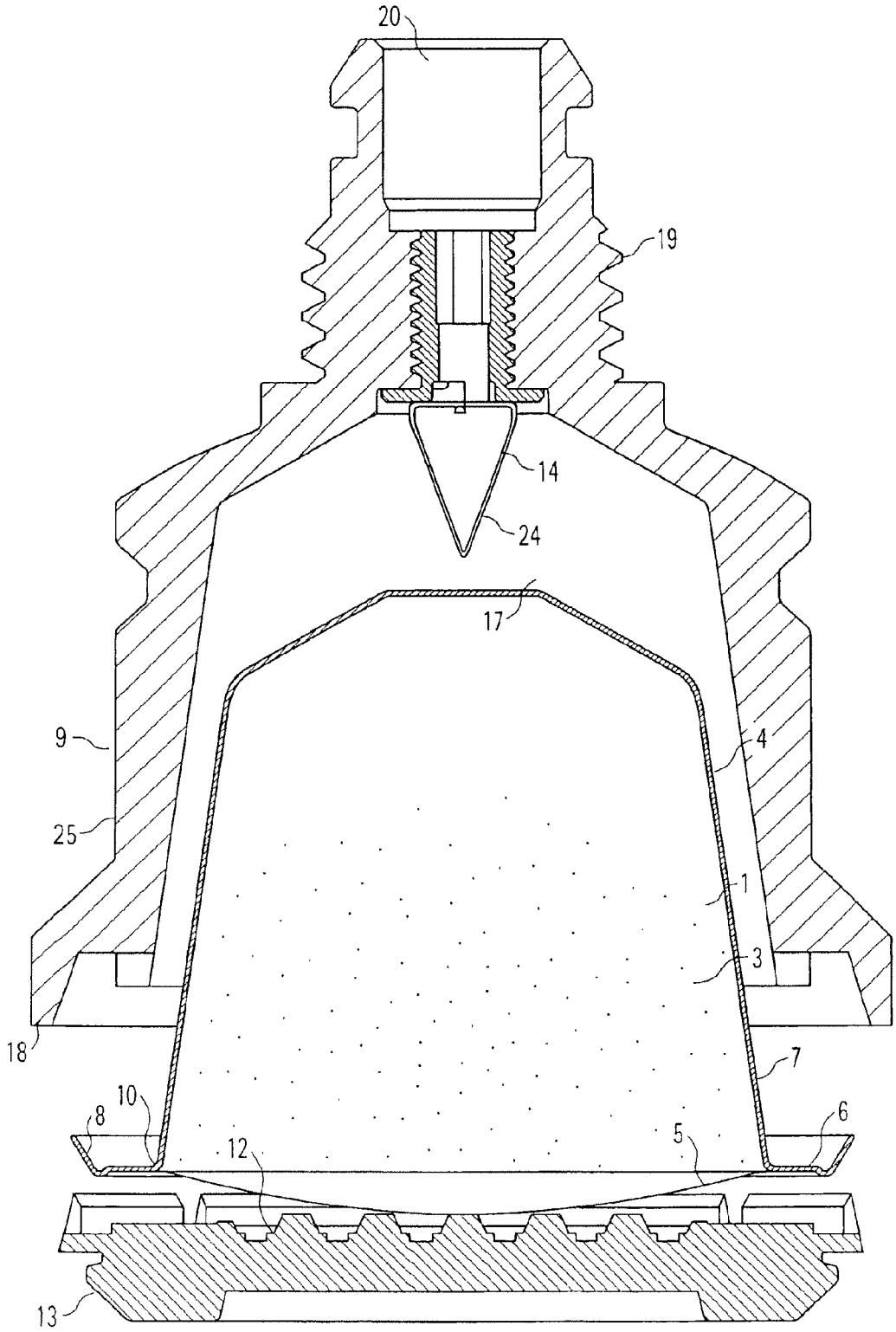
FIG. 2 shows an embodiment of the present invention in which a capsule is placed on the capsule holder but has not yet reached its closing position in the beverage production device.

FIG. 2 shows a state in which a user has placed such a capsule on a capsule holder 13, the foil member 5 resting on the relief element 12 side of the capsule holder 13 and the cup-like base body 4 of the capsule 1 being already partly surrounded by the circumferential wall 25 of an enclosing member 9 of the beverage production device 2. The shown enclosing member has the shape of a bell. Other shapes are viable, wherein the design of the recess of the enclosing member is generally adapted to the contours of the capsule 1.

Note that the foil member 5 as shown is not exactly flat due to a defined over pressure inside the capsule, which over pressure is generated by introducing e.g. a protective gas when producing the filled capsule 1.

The enclosing (bell) member 9 furthermore comprises an annular support skirt 18, the function of which will be explained later, an external thread 19 for mounting the bell member in a beverage production device and a water inlet opening 20 for feeding a liquid such as for example hot water under pressure to a water injector 14 which is releasable mounted (screwed) to the bell member 9. Note that the thread 19 is just an example for connection means, be it releasable or permanent connection means.

The other components of the beverage production device, such as e.g., the mechanism for displacing the bell member and eventually also the capsule holder are known from the prior art in the field of capsule-based espresso machines.

The water injector comprises a perforation element (blade, pin, etc.) 14 designed to produce an opening in the bottom wall 17 of the capsule 1 when the capsule holder 13 and the bell member 9 are moved close together e.g. by a manually operated or an automatic mechanism. A channel or aperture (not shown in the drawings) traverses the perforation element 14, to create a larger opening section than the actual plain section of the perforation element, such that water can be fed to the interior of the capsule 1 once the perforation element 14 protrudes into the interior of the capsule 1. Note that the capsule could present a preconfigured hole for water inlet and that the water injection means could be a tube or outlet that fits the preconfigured hole of the capsule. In such a case the opening would be created without generating a perforation, but using opening means such as a valve etc.

The capsule 1 according to the depicted embodiment comprises said top wall 17, a side wall 7 and a flange-like rim 6, wherein the foil member 5 is sealed to said flange-like rim 6 to close-off hermetically the cup-like base body 4 of the capsule 1. Again, other designs for the capsule are possible as long as the capsule can be sealed and contain the mentioned ingredients.

According to the present invention, the exterior of the capsule 1 presents a dedicated sealing member 8. The sealing member 8 can be resilient due to the material used and/or due to the geometrical shape of the sealing member 8. Further on, the sealing member 8 can be integral to the capsule 1 or a separate piece. In the latter case the sealing member can be mounted releasably to the base body 4 or fixed thereto e.g. by welding or by means of an adhesive.

In case the sealing member 8 is a separate piece attached to the capsule 1, it can be mounted to the capsule as one integral piece. Alternatively it can be applied in fluid or viscous form and then can harden (e.g. can polymerize) once applied onto the outer surface of the capsule, which is the case e.g. when applying silicone. If a resilient material is used for the sealing member 8, preferably rubber-elastic or similar elastomeric materials are used. In case the material of the sealing member is the same as the one used for the capsule (e.g. a metal such as aluminum, or plastics), preferably the resilient nature of the sealing member is procured by the geometrical shape of the sealing member.

In the embodiment according to FIG. 2 the sealing member 8 is resiliently deflectable due to the lip-shaped form. It is made from the same material as the capsule, preferably plastics. It can be an integral piece of the base body 4 of the capsule 1. The flexible lip 8 extends from the outer edge of the flange-like rim 6. The sealing member 8 prolongs a clamping portion 29 of the flange like rim but it is not supposed to be clamped so as to be able to deflect freely under pressure. The clamping portion 29 of the flange-like rim is configured to form an annular surface that is clamped at least partially by the matching surfaces of the beverage production device. As a result, the sealing member 8 is released from the forces or stresses that can apply onto the rim as a result of the tearing of the foil member 5 onto the relief elements 12.

Note that such deflectable sealing member 8 can be placed at any position onto the capsule 1 as long as the position is adapted for an exterior sealing engagement of the sealing member 8 and the enclosing member 9 between the water injector 14 and the perforations in the foil member 5. The sealing member 8 can also be provided on the region of the top wall 17 of the capsule 1 surrounding the water injector 14 when the water injector is in a position protruding into the interior of the capsule 1. The sealing member 8 can also be arranged to cover different portions (top, side wall, flange-like rim) of the capsule.

Figure 3:
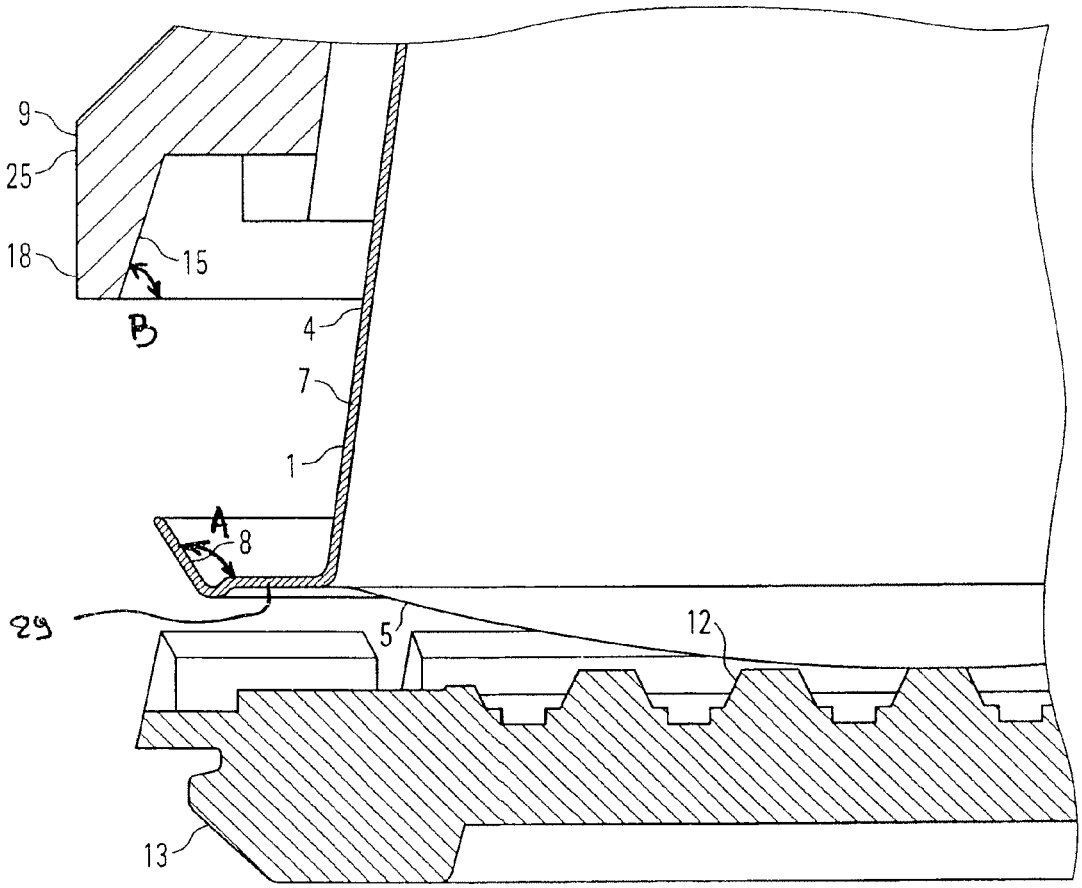
FIG. 3 shows an enlarged view of FIG. 2.

As can be seen in detail in FIG. 3, the bell member according to this embodiment does not comprise any dedicated resilient sealing member. However, the enclosing member 9 of the beverage production device 2 optionally can also comprise a resilient sealing member. A divergently inclined sealing surface 15 of the bell member 9 is designed to cooperate with the resiliently deflectable sealing member 8 of the capsule 1. The inclination of the sealing surface is opposite to the inclination of the free flexible lip constituting the sealing member.

Depending on the form and material of the sealing member 8 of the capsule 1, the cooperating surface of the bell member 9 can have any shape, position and orientation which are adapted for a sealing engagement with the sealing member 8 of the capsule 1.

Figure 4:
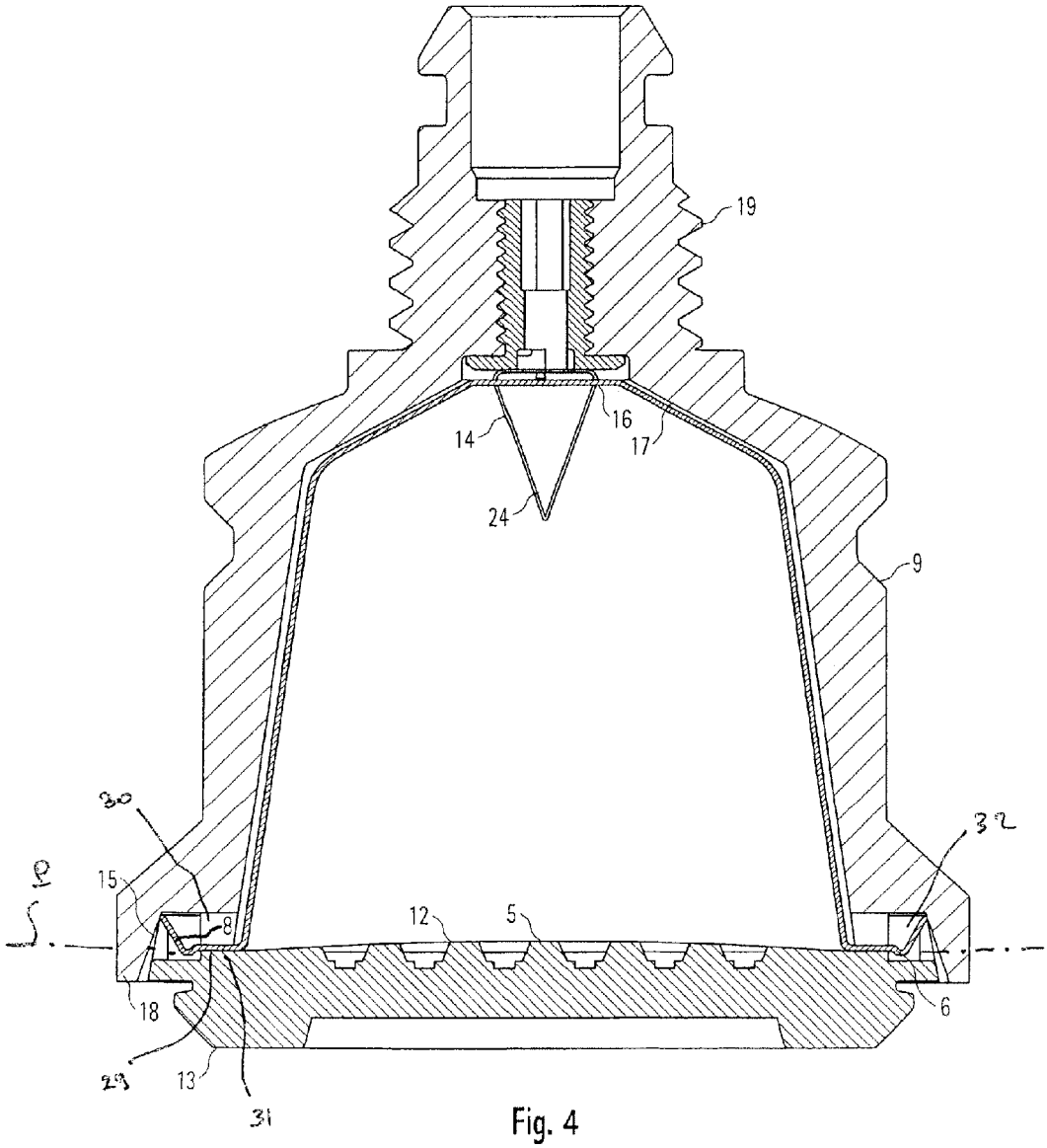
FIG. 4 shows the embodiment in a state, in which a capsule has reached its closing position between a bell member and the capsule holder.

Upon closing of the device about the capsule, as shown in FIG. 4, the bell member 9 and capsule holder 13 clamp together the capsule along the clamping portion 29 of the flange-like rim. For this the bell member 9 can include one or more annular raising portions that firmly pinch or clamp the clamping portion 29 of the capsule onto a receiving portion surface 31 of the capsule holder. The clamping portion can further form an indent that is complementary an indentation of the surface 31. Therefore, an annular chamber 32 is formed as resulting from the assembly in closure of the bell member 9 and capsule holder 13 that encloses the sealing member 8. As a result the capsule is firmly held in place and tensile forces are released at the free lip that can deflect freely in the chamber toward the inclined surface 15 whereby a perfect watertight sealing can be obtained.

FIG. 4 shows the state in which the bell member 9 and the capsule holder 13 are brought in closing pressure engagement and due to the water entering the interior of the capsule and building up a pressure there the pyramidal relief members 12 of the capsule holder 13 have already produced openings in the foil member 5 of the capsule 1. Upon insertion of the capsule the blade element of the water injector creates a perforation 16 in the top wall 17 of the capsule 1 when a sufficient pressure is build inside the capsule. The beverage produced from the ingredients contained in the capsule can be drained in small interstices between the relief members 12 and the surrounding foil member 5.

In the state shown in FIG. 4 the resiliently deflectable sealing member 8 of the capsule 1, i.e. the flexible lip, is biased against the corresponding inclined sealing surface 15 of the enclosing member 9. The flexible lip is the edge of the side walls of the base body of the capsule, which edge is bent by an angle A, at rest, (relative to the flat clamping portion 29 of the rim or sealing plane P) of more than about 90 degrees, preferably comprised between 95 and 175 degrees. The sealing surface 15 forms preferably an angle of inclination B relative to the sealing or closure plane P, when measured in the inward direction toward the capsule, of 90 degrees or less. Preferably the angle of inclination B is of from 85 to 50 degrees. The initial biasing force thus is the force pressing the sealing member 8 against the sealing surface 15 of the beverage production device before water is injected into the capsule. This biasing force will usually be generated by slightly deflecting the sealing member during the relative movement between the enclosing member 9 and the capsule 1 resting on the capsule holder 13. It can be noted that the sealing member may also be biased against the upwardly raising edge 28 of the holder 13 to complete the sealing arrangement. To this effect the edge 28 can comprise an inclined terminal surface, as shown in FIG. 3, against which the sealing member is further biased.

The annular support skirt 18 now covers the end of the flange-like rim 6 of the capsule 1 while the clamping portion 29 is clamped between surfaces 30, 31 of the device to assure that the sealing member 8 can freely deflect and the capsule remain in position when the sealing surface 15 of the bell member exerts a defined pressure of the sealing member 8.

Actually, the lip-shaped sealing member 8 represents an example of a construction providing a self-reinforcing sealing arrangement when in water pressurized engagement with the sealing surface(s) of the beverage producing device. Preferably, the self-reinforcing effect is achieved by using the water pressure to strengthen the sealing engagement, and not to weaken it. Generally, the water pressure will act on the sealing member of the capsule such that it is pressed against the cooperating sealing surface, with a force higher than the initial biasing.

Water coming from the water injector will be pressed into the interstice between the exterior of the capsule and the enclosing member and will eventually arrive at the lip-shaped sealing member. The lip-shaped sealing member will at least partially hinder the water flow as it is biased against the sealing surface of the annular member. This initial flow-hindering effect will lead to the pressure raising at the upstream-side of the sealing member which in turn will lead to the sealing member being pressed even stronger against the sealing surface and thus to a sealing engagement which is the stronger the higher the water pressure at the sealing engagement.

Note that it is not necessary that the sealing engagement is already perfectly in place before the water is injected, as long as there is a contact, preferably some biasing of the sealing member against the sealing surface of the enclosing member which will lead to a pressure at the sealing member which, in turn, will produce the proper sealing engagement stopping the water flow. The self-reinforcing approach can thus lead to a dynamically evolving sealing engagement.

To a certain degree it is even acceptable that some external water flow occurs at the beginning of the water injection, which initial water flow will then be stopped by automatically by the dynamics of the sealing engagement. This is in contrast to known sealing technologies, where the initial sealing effect tends to get weaker along with the course of the water injection.

Even if the sealing surface is not perfectly clean or smooth, the dynamics of the sealing engagement can still lead to a proper sealing. In contrast to known sealing engagements in the present technical field the water pressure is working for the sealing effect and not against it.

Note that according to the depicted embodiment the initial contact area between the sealing member and the cooperating sealing surface has the form of a circular line. When pressurized, this contact area will actually get more and more the form of a ring-shaped surface due to the deformation of the sealing member. Alternative designs can present already an initial ring-shaped contact area. While in the present embodiment initially (i.e. in the non-pressurized state) essentially only the outer edge of the lip contacts the cooperating sealing surface 15. Other designs can be thought of according to which a larger portion or even the entire sealing member is in contact with the cooperating sealing surface.

Alternatively the cooperating surface of the enclosing member of the beverage production device is not a plane surface, but e.g. a protruding ring against which the sealing member is initially biased. In such a scenario the initial contact area can be line-shaped. In any case, when pressurized by water pressure, the flexible sealing member 8 of the capsule 1 will adapt its shape even closer to the cooperating surface of the beverage production device.

When the capsule 1 is in a position as shown in FIG. 4 and then, after having finished the beverage production process, the holder 13 is opened and the capsule is removed from the capsule holder 13 or bell member 9.

Figure 5:
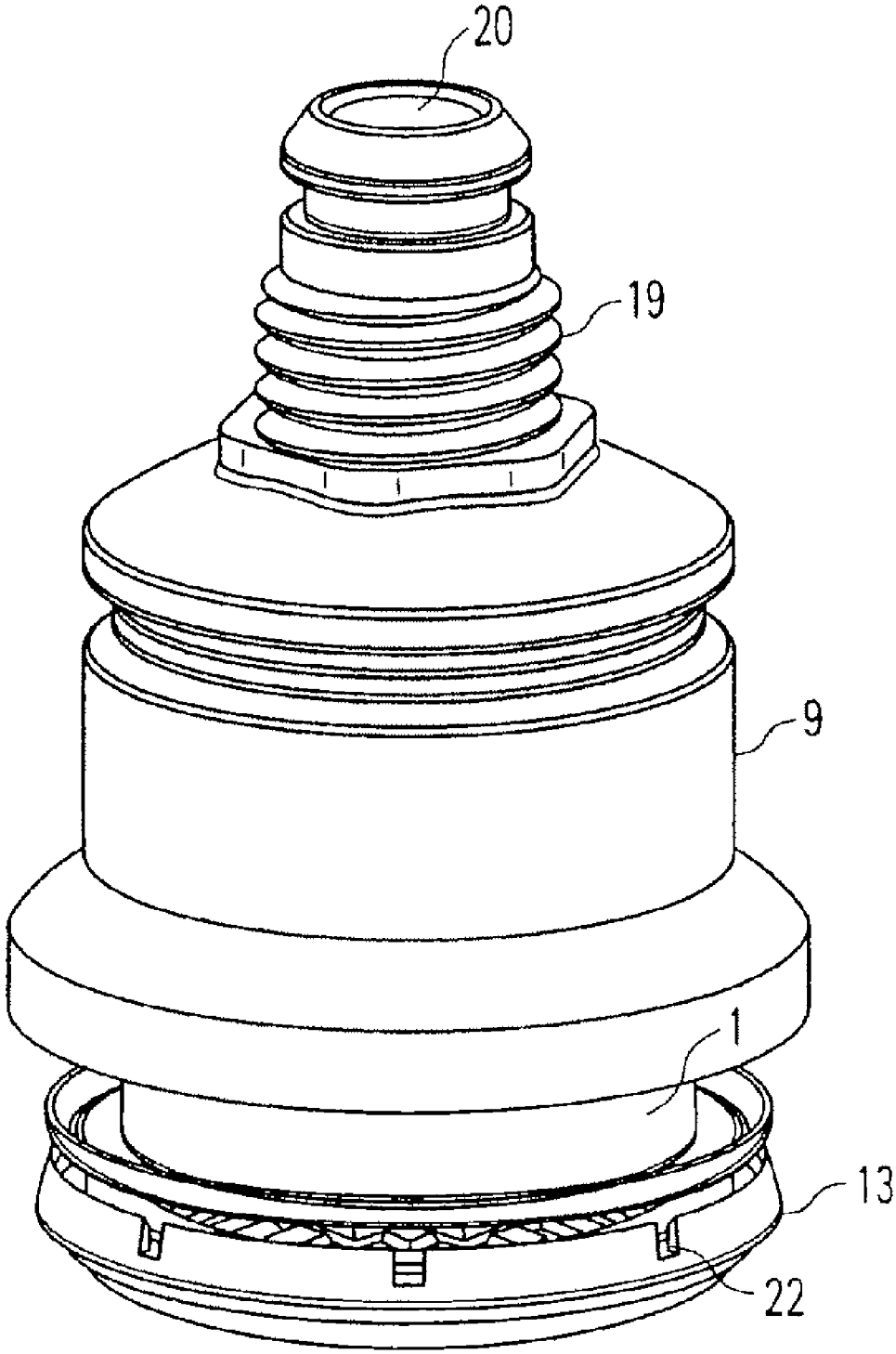
FIG. 5 shows a perspective view of a capsule holder, a bell member and a capsule according to the embodiment in a position in which the capsule has not yet reached its closing position.

In the embodiment of FIG. 5 grooves 22 are provided in the circumference of capsule holder 13, i.e., evenly cut in the upwardly raising edge 28, which grooves 22 act to drain liquid that would have settled or accumulate on the surface of the capsule holder or dripping out of the capsule before the capsule can be removed.

What is claimed is:

1. A capsule comprising a chamber defining an interior for containing beverage-forming ingredients, wherein the capsule is operatively associated with a beverage production device such that a liquid under pressure from the device can enter the capsule in order to interact with the beverage-forming ingredients therein and form a beverage, with the capsule having an exterior surface with a flange-like rim that presents a resiliently deflectable sealing member for sealingly engaging the beverage production device in order to assist in directing the liquid to traverse the capsule interior without leakage so that the liquid contacts the beverage-forming ingredients and forms the beverage, wherein the resiliently deflectable sealing member has a lip-shaped form and is part of the flange-like rim of the capsule, wherein the resiliently deflectable sealing member is a free lip extending from the rim of the capsule and outwardly away from the capsule.

2. The capsule according to claim 1, wherein the sealing member is geometrically arranged to be biased against at least one sealing surface of the beverage production device when the capsule is positioned in the beverage production device.

3. The capsule according to claim 2, wherein the sealing member is configured to be biased against a sealing surface of an enclosing member of the beverage production device.

4. The capsule according to claim 1, wherein the flange-like rim comprises a clamping portion that applies clamping forces when the capsule is held in position in the beverage device.

5. The capsule according to claim 1, wherein the capsule chamber is in the form of a cup-shaped base body, and the resiliently deflectable sealing member is provided upon a side wall of the base body of the capsule.

6. The capsule according to claim 1, wherein the sealing member is made of a flexible material.

7. The capsule according to claim 1, wherein the capsule and the sealing member are made of plastic.

8. The capsule according to claim 1, wherein the sealing member is configured, dimensioned and positioned to produce a self-reinforcing sealing arrangement when pressurized against the sealing surface.

9. A beverage producing system, comprising a capsule according to claim 1 and a beverage production device, with the beverage production device having at least one sealing surface against which the sealing member of the capsule is biased when the capsule is positioned in the beverage production device or when a fluid pressure is established in the beverage production device so that the liquid traverses the capsule interior without leakage so that the liquid contacts the beverage-forming ingredients and forms the beverage.

10. A beverage producing system, comprising a capsule according to claim 1 and a beverage production device, with the beverage production device having an enclosing member with a sealing surface that is in sealing engagement with the sealing member of the capsule when the capsule is positioned in the enclosing member, such that the sealing engagement is self-reinforcing when pressurized so that the liquid traverses the capsule interior without leakage so that the liquid contacts the beverage-forming ingredients and forms the beverage.

11. The capsule according to claim 1, wherein the lip-shaped form comprises a flat portion and an extension arranged at an angle to the flat-shaped portion.

12. The capsule according to claim 11, wherein the extension of the flexible lip extends from the flat portion of the sealing member at an angle of between 95 and 175 degrees when at rest.

13. The capsule according to claim 12, wherein the extension of the flexible lip is connected to the flat portion by an arcuate portion.

* * * * *